US005592896A

United States Patent [19]

Cassidy

[11] Patent Number: 5,592,896

[45] Date of Patent: Jan. 14, 1997

[54] ASSEMBLEABLE ANCHOR LANDSCAPING DEVICE

[76] Inventor: Francis J. Cassidy, Three Leisure Retail Center, Long Neck, Del. 19966

[21] Appl. No.: 529,652

[22] Filed: Sep. 18, 1995

[51] Int. Cl.[6] ..... B63B 21/24

[52] U.S. Cl. ..... 114/303

[58] Field of Search ..... 114/294, 303, 114/301

[56] References Cited

U.S. PATENT DOCUMENTS

| | | | |
|---|---|---|---|
| 242,957 | 6/1881 | Moule . | |
| 294,813 | 3/1884 | Schmeelk | 114/303 |
| 857,094 | 6/1907 | McBride . | |
| 1,036,275 | 8/1912 | Langford . | |
| 2,012,751 | 8/1935 | Buch . | |
| 2,526,214 | 10/1950 | Faraone . | |
| 2,595,966 | 5/1952 | Majors | 114/303 |
| 2,625,898 | 9/1950 | Southard . | |
| 3,023,723 | 3/1962 | Tays | 114/303 |
| 3,585,218 | 11/1966 | Gilbertson et al. | 114/303 |
| 4,592,300 | 6/1986 | Swarbrick . | |
| 4,785,758 | 11/1988 | Eichelberger, Sr. | 114/301 |

*Primary Examiner*—Sherman Basinger
*Attorney, Agent, or Firm*—Connolly & Hutz

[57] ABSTRACT

An assembleable anchor-type landscaping device which is lightweight, durable, and capable of being moved and shipped with minimal expense. The anchor device comprises a detachable connected ring, a hollow shank which is formed in multiple portions which are removably connected, a hollow removable stock, hollow and removable arms, and detachable fluke members (optionally hollow). The anchor may be variably filled with a ballast material to achieve appropriate landscaping weight.

3 Claims, 3 Drawing Sheets

ASSEMBLEABLE ANCHOR LANDSCAPING DEVICE

FIELD OF THE INVENTION

This invention relates to the field of devices used in landscaping as structural or aesthetic elements. Frequently, homeowners or businesses attempt to design a "theme" for a community. Often, Western-style ranch houses will be clustered together, or alpine ski chalets will be grouped together in an attempt to make a community's appearance more uniform and pleasing to the eye.

To accomplish this result, often certain details or elements are incorporated into a house's structure. For a ski chalet, for instance, a pointed roof built on an a-frame type structure is used. For a western-oriented community, split rail fences and horse posts may be installed as structural elements around the property. These are heavy, structural elements, and must be trucked or shipped in, often at great expense.

A more specific building theme which is prevalent in coastal areas is the nautical theme. This theme incorporates, as structural elements, pilings wrapped in rope used for foundations, walls, and fencing. Interior touches such as highly varnished surfaces, brass fittings, and nautical instruments (i.e. sextants, compasses, wheels, and other navigational instruments) are frequently used to complement the finished product.

However, one of the most frequently sought after items for complementing a landscaping or decorating job is the most expensive and completely unavailable item—an anchor. The United States Power Squadrons 1989 guide book lists several typical anchors, among them the classic "Kedge" anchor, the "Danforth" anchor, the "CQR" or "Plow" anchor, the "Bruce" anchor, the "Grapnel" anchor, and the "Mushroom" anchor.

By far, the "classic" and most highly prized anchor is the Kedge anchor, which has a ring attached to the upper portion of the shank, a stock with balls at either end and a 90° bend at one end, a key which holds the stock in place, a vertical shank extending down to a crown, from which extend arms. The arms are fitted with flukes, which are wide sections (palms) and having pointed ends (bills).

Depending upon the size and weight of the boat to be anchored, the anchors weigh from 25 pounds at the smaller end (for fishing boats, etc.) up to many tons for cargo vessels. Obviously, for an anchor to have any practical use in a vessel, it must be small enough to fit within the confines of the vessel conveniently yet have enough weight to hold the boat securely.

For an anchor to have a decorative use which is worthwhile, it must be of a certain minimum size, generally having a shank of from 2 to 6 feet, preferably from 3 to 5 feet, most preferably 4 feet. An anchor (Kedge type) having a shank of two feet will weigh anywhere over 100 pounds, while a six foot shank Kedge will be five hundred or more pounds. While such anchors have been used in the past as structural and aesthetic elements in dwellings and businesses, they are virtually impossible to find (other anchors are far more practical to use on a boat), and once found, can require a crane to install.

PRIOR ART

Applicants are aware of several attempts to make anchors on boats more stowable. The original Kedge anchor (dating back thousands of years) was formed without a crossing stock. However, this design was unwieldy when on the deck of a ship, so a crosspiece was fitted angularly displaced at 90° about the shank, so that the anchor would not lie flat on the deck. This also had the fortunate effect of making the anchor more effective (it would no longer just slide along the bottom). As machinery became more efficient, the stock was made removable, using a key, so that the anchor could be stored in a smaller space.

Moule, U.S. Pat. No. 242,957 describes an improved shackle bar for a marine use Kedge anchor, wherein the ring has been replaced with a clevis bolt and clevis for preventing anchor fouling.

McBride, U.S. Pat. No. 857,094 describes a marine use anchor with collapsible flukes, which enables the anchor to be stowed in a smaller area.

Langford, U.S. Pat. No. 1,036,275 describes a marine use anchor with a sliding stock, which slides through an eye in order that it may lie flat against the stock, likewise, for ease of storage. There is a latch which holds the stock in place when in use.

Buch et al. U.S. Pat. No. 2,012,751 describes a collapsible marine use anchor which has a stock containing an apparatus for raising and lowering the flukes.

Faraone, U.S. Pat. No. 2,526,214 describes a four fluked marine use anchor which is said to be foldable and stowable compactly when not in use. Faraone describes an anchor shank having a threaded stem which a fluke can attach to. The fluke is removable by action of a nut on the stem, and may be secured to the side of the shank.

Southard, U.S. Pat. No. 2,625,898, (similar to Langford) describes a marine use anchor having a sliding stock which can move to come parallel with the shank. A lug and shank collar apparatus hold the shank in place when in use.

Swarbrick, U.S. Pat. No. 4,592,300 discloses a marine use anchor having a shaft, shank, and flukes, each of which is solid and held in place by pins. The entire assembly can be disassembled and stored when not in use. The disclosure notes that there is "no need to interfere with the stock in a way which could reduce its strength".

Applicants are aware of no device which even remotely accomplishes the results of the instant invention.

SUMMARY OF THE INVENTION

Applicants have developed a novel anchor device which is lightweight, large, yet easily disassembles and assembles, can be adjusted weightwise, and is otherwise indistinguishable from a functioning anchor.

The anchor according to the present invention contains a ring portion, which is detachably connected to a shank portion (optionally divided into a plurality of shank portions, e.g. a shank upper portion connected to a shank lower portion).

The shank portion is formed with at least one hole located proximate to the upper shank end portion. A stock is removably inserted into the hole. The stock may be formed in a plurality of sections, preferably in two sections which attach at the hole formed in the shank. One end of the stock is preferably formed with a 90° turn ending in a ball, and the other end is straight ending in a ball. The ball is preferably only slightly larger in diameter than the stock.

A removable crown portion is attached to the lowermost end of the shank. Two arms, preferably detachable, connect flukes having palms and bills to the crown portion.

The shank, if formed from a very heavy material such as steel, is formed with at least one recess therein, making it substantially hollow. The same applies, individually, for the flukes, crown, arms, and stock.

Preferably, however, the components of the present invention are formed from aluminum, which is a light element, and the portions may be selectively hollow or solid, depending upon the weight of the material selected. High impact plastic, fiberglass, or other suitable materials may be used. It is most preferred that the largest anchors according to the present invention, without additional ballast, weigh under 100 pounds, particularly preferred are anchors weighing under 50 pounds. It is unnecessary for the anchor to sink, therefore a material weighing less than 1 g/cc may be used.

It is notable that such anchors, while appearing to the eye to be kedge anchors, are too large to fit within a boat which could be held by their weight, and kedge anchors of appropriate "size" for a boat, could not hold a boat as they would generally be of insufficient weight.

The anchor according to the present invention may be finished in a variety of suitable coatings, including blueing or blacking through means which are known in the art. Finishing the anchor in a black finish is most preferred.

The anchor portions are preferably connected by a threaded socket-threaded stem connecting device, which enables the parts to be manually screwed together.

BRIEF DESCRIPTION OF THE DRAWINGS

Novel features and advantages of the present invention in addition to those mentioned above will become apparent to persons skilled in the art from a reading of the following detailed description in conjunction with the accompanying drawings wherein.

DETAILED DESCRIPTION OF THE INVENTION

Figure 1:
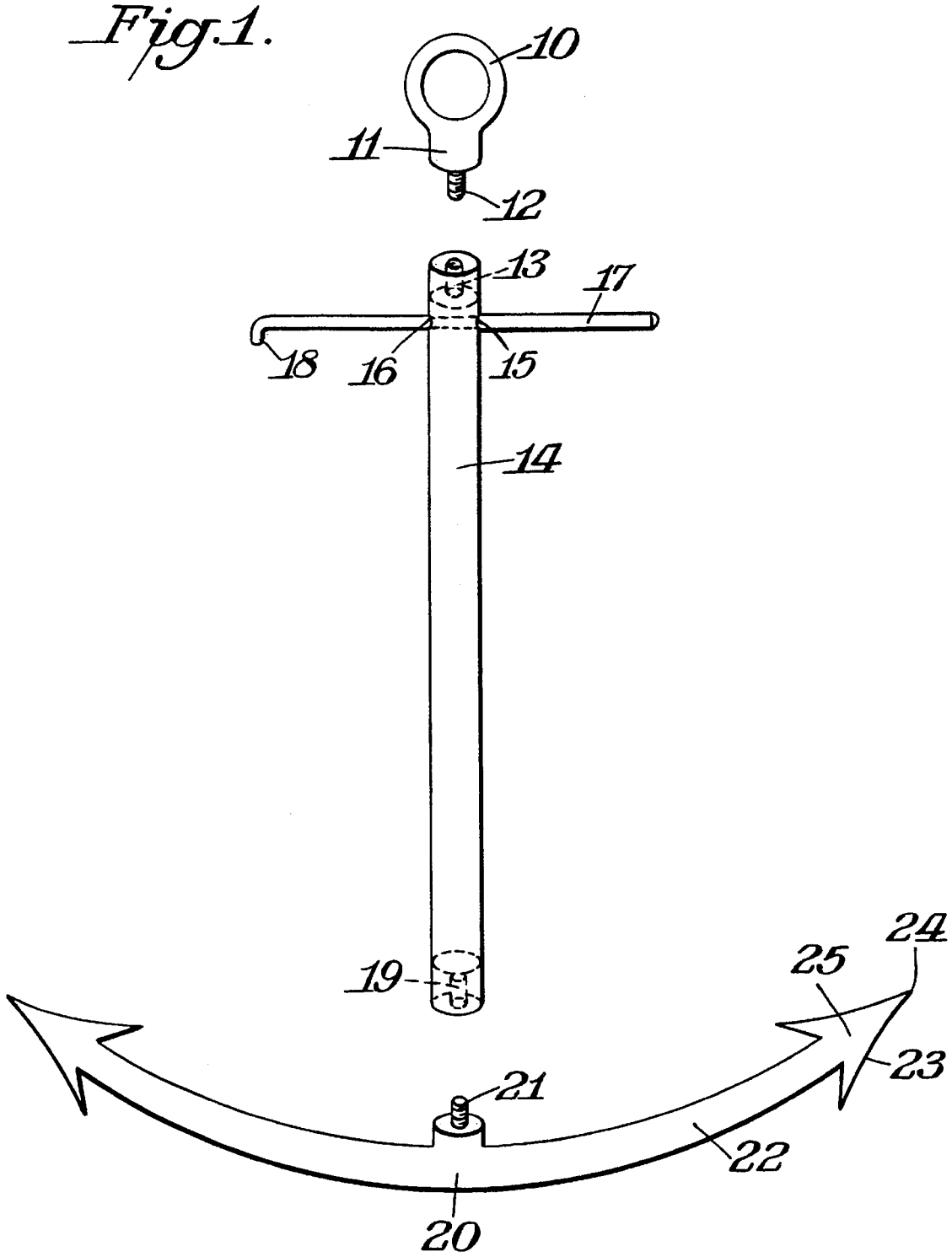
FIG. 1 is an exploded perspective view of a decorative anchor, according to the present invention.

FIG. 1 is a schematic illustration of an anchor according to the present invention. It comprises a ring 10 with base 11 which in this embodiment is formed with a threaded stem 12. The threaded stem fits in threaded engagement a first aperture 13 which is at one end of a hollow shank. First aperture 13 has correspondingly threaded interior surfaces for accepting the threaded stem 12.

Shank 14 is formed with transverse holes 15 and 16. Stock 17 is frictionally engaged therein. Stock 17 is formed with an approximately 90° bend at one end to form hook 18. Shank 14 also is formed with second aperture 19, which is threaded along its interior walls.

Crown portion 20 is formed with threaded stem 21. Threaded stem 21 threadedly engages second aperture 19. Crown portion 20 is also formed with arms 22 which extend into fluke portions 23 formed with bills (points) 24, and each fluke has also a flat portion (palm) 25 formed thereon.

Figure 2:
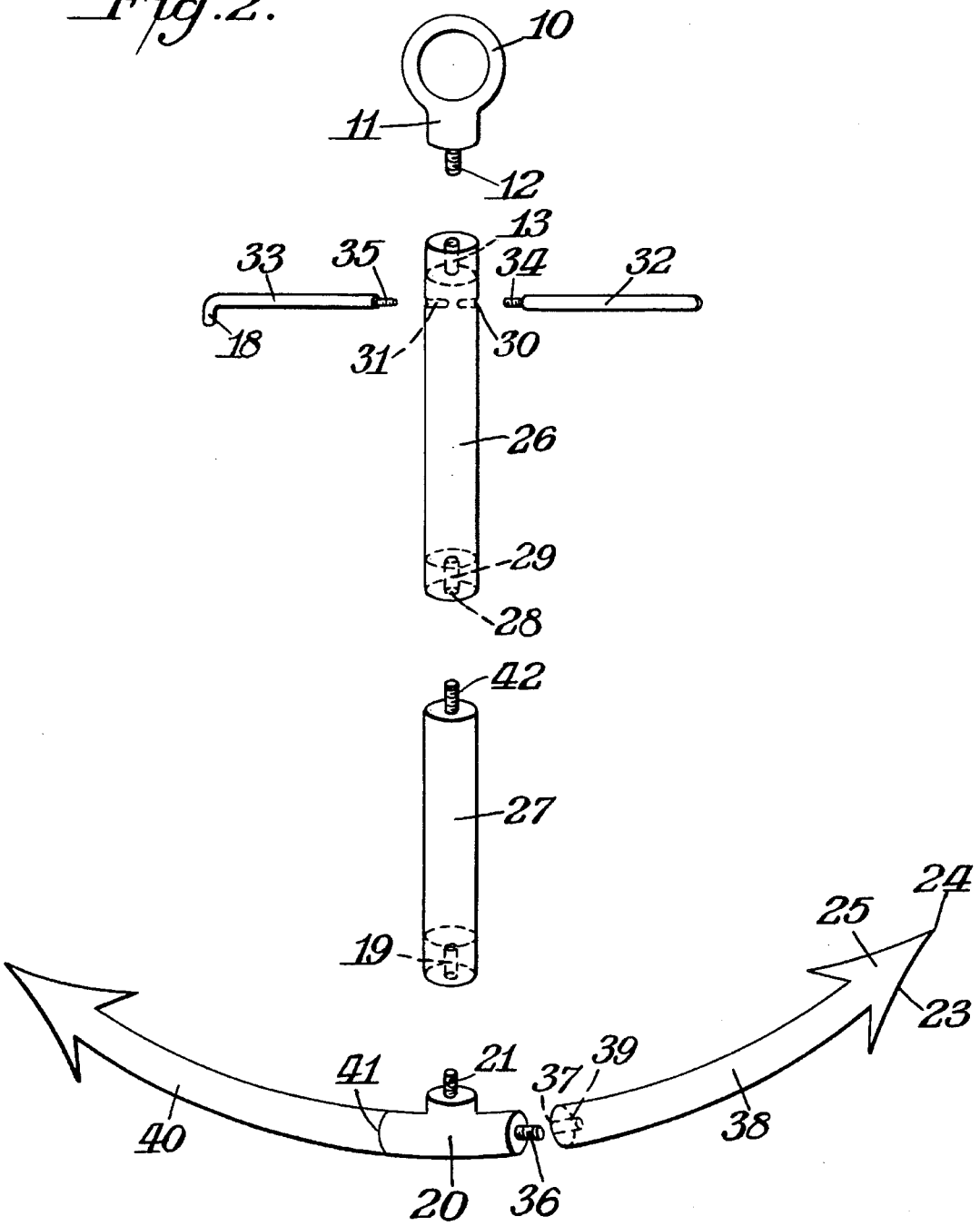
FIG. 2 is an exploded perspective view of another embodiment of a decorative anchor, according to the present invention.

FIG. 2 illustrates an alternative embodiment of the present invention. The shank is divided into an upper portion 26 and a lower portion 27. Shank upper portion 26 is formed with jointing aperture 28 having threaded inner surface 29. Shank upper portion 26 is also formed with side apertures 30, each having a threaded inner surface 31. The stock is divided into a first portion 32 and a second portion 33. Stock first portion 32 is formed with threaded stem 34, and stock second portion 33 is formed with threaded stem 35. The threaded stems engage the threaded inner surfaces of the side apertures.

The crown is formed with threaded stem 36 which engages mounting aperture 37 formed in detachable first arm portion 38. Threaded stem engages threaded inside sidewalls 39 of mounting aperture 37. Detachable second arm portion 40 is mounted to crown 20 as seen by seam 41. The fluke portions 23 may be detachably connected to the arms 22 by threaded joint connections similar to those utilized in connecting the arms to the crown.

Shank lower portion 27 is formed with jointing threaded stem 42 which engages jointing aperture 28 and the threaded inside walls 29 of shank upper portion 26 to form the complete shank.

Figure 3:
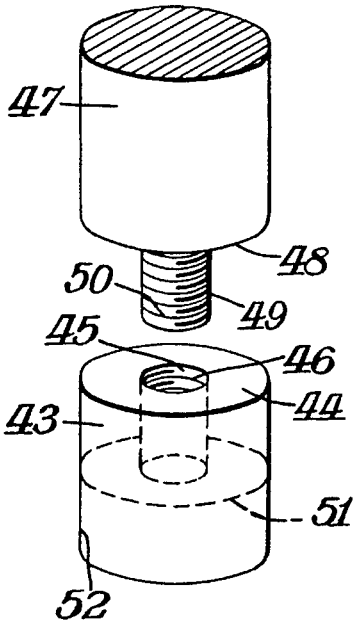
FIG. 3 is an enlarged perspective view illustrating the threaded joint connections used in the decorative anchor of the present invention.

FIG. 3 illustrates a typical threaded joint which is preferred in the present invention. Female end portion 43 is formed with end surface 44. End surface 44 has aperture 45 formed therein, which is threaded by threads 46. Male end portion 47 is formed with end face 48 and threaded stem 49. Threaded stem 49 is formed with threads 50 which match the pitch, spacing, turns, and depth of threads 46.

Aperture 45 extends inwardly towards the interior of the anchor structural element, which is hollow. End surface 44 is formed with a certain thickness to form a plate and terminates with an interior surface 51 (shown in phantom). Interior surface 51 delimits (shown in phantom) an interior hollow cavity bounded by walls 52. In a different embodiment, the aperture may not extend through the thickness of the plate and may not provide access to the interior hollow cavity.

Figure 4:
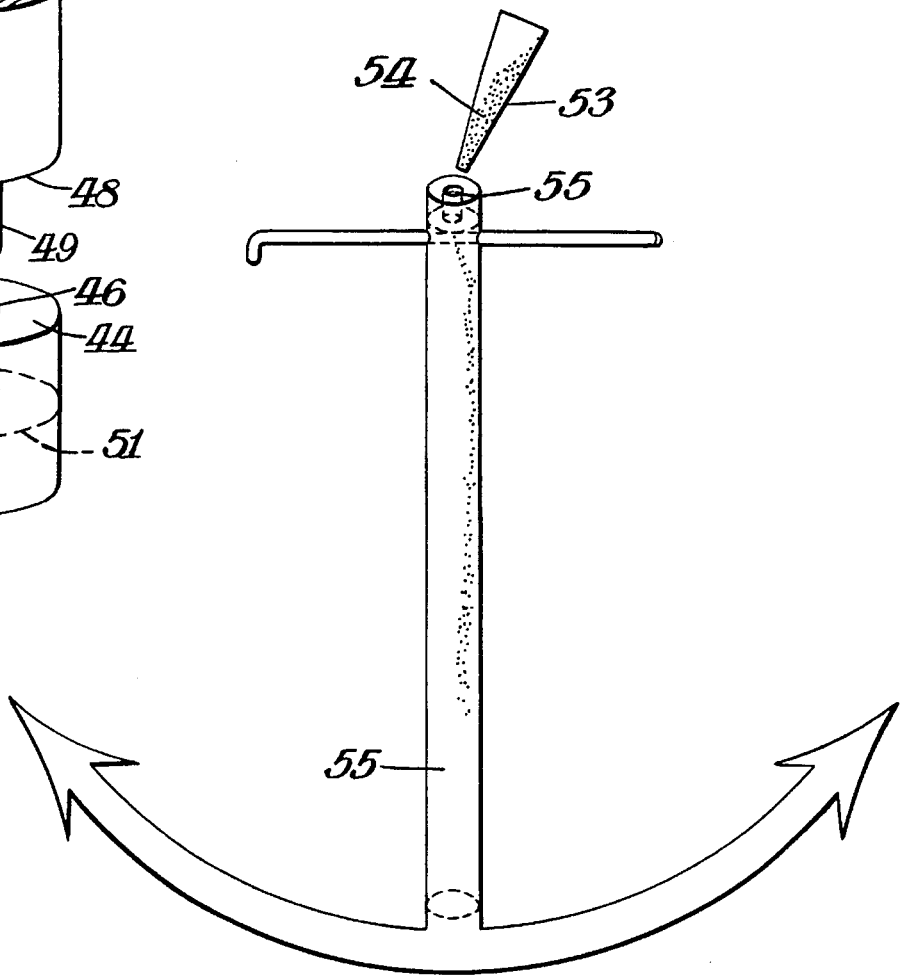
FIG. 4 is a perspective view of the decorative anchor of the present invention filled with ballast material.

FIG. 4 illustrates a particularly preferred embodiment of the present invention. Filler device 53 dispenses fill 54 which may be sand, gravel, or any other suitable substance. Fill 54 travels through aperture 55 and fills cavity 55 to a desired level. Cement may optionally be used for a permanent installation.

Having described the invention in the foregoing specification, I claim:

1. A decorative kedge anchor for landscape use comprising a shank having an upper end portion, a lower end portion and a hollow cavity, a hollow crown having a detachably connected first arm and a detachably connected second arm each arm having a fluke and extending in opposite directions, a removable stock connected to the shank and extending outwardly therefrom, the stock including two portions each removably connected to the shank and extending outwardly therefrom in opposite directions, and a ring, wherein the ring is formed with a threaded portion, the shank upper end portion is formed with a threaded portion which corresponds to the ring threaded portion, and threadedly engages the ring threaded portion whereby the ring is detachably mounted to the upper end portion of the shank, the shank is formed with side apertures which releasably engage the removable stock portions, the shank lower end portion detachably engages the crown, and the shank comprises multiple shank portions along its length which detachably engage one another.

2. An anchor as claimed in claim 1, wherein the hollow cavity in the shank is filled with removable ballast.

3. An anchor as claimed in claim 1, wherein the hollow crown is filled with removable ballast.

* * * * *